US008399062B2

(12) United States Patent
Romes et al.

(10) Patent No.: US 8,399,062 B2
(45) Date of Patent: Mar. 19, 2013

(54) ELASTOMERIC FOAM PRODUCT

(75) Inventors: Gary E. Romes, Greer, SC (US); William H. Crostic, Jr., Simpsonville, SC (US)

(73) Assignee: Guardian Building Products, Inc., Greer, SC (US)

( * ) Notice: Subject to any disclaimer, the term of this patent is extended or adjusted under 35 U.S.C. 154(b) by 704 days.

(21) Appl. No.: 12/557,570

(22) Filed: Sep. 11, 2009

(65) Prior Publication Data

US 2010/0068463 A1 Mar. 18, 2010

Related U.S. Application Data

(60) Provisional application No. 61/096,497, filed on Sep. 12, 2008.

(51) Int. Cl.
*B05D 3/00* (2006.01)

(52) U.S. Cl. ..... 427/384; 427/385.5

(58) Field of Classification Search ..... None
See application file for complete search history.

(56) References Cited

U.S. PATENT DOCUMENTS

| | | | | |
|---|---|---|---|---|
| 3,993,606 | A | 11/1976 | von Bonin et al. | |
| 4,451,587 | A | 5/1984 | Keshi et al. | |
| 4,525,490 | A | 6/1985 | Smith | |
| 5,059,671 | A | 10/1991 | Taniguchi et al. | |
| 5,300,531 | A * | 4/1994 | Weaver | 521/51 |
| 5,338,820 | A | 8/1994 | Harrison et al. | |
| 5,491,252 | A | 2/1996 | Narayan et al. | |
| 5,624,968 | A * | 4/1997 | Gabbard | 521/107 |
| 5,855,818 | A | 1/1999 | Gan et al. | |
| 6,031,010 | A | 2/2000 | Lin | |
| 6,376,698 | B1 | 4/2002 | Bleys | |
| 6,648,189 | B1 | 11/2003 | Minton et al. | |
| 6,884,824 | B2 | 4/2005 | Bleys et al. | |
| 2005/0282989 | A1 * | 12/2005 | Rosthauser | 528/44 |
| 2006/0047010 | A1 * | 3/2006 | O'Leary | 521/155 |
| 2006/0272280 | A1 | 12/2006 | Romes et al. | |
| 2007/0197672 | A1 * | 8/2007 | Lekovic et al. | 521/103 |
| 2010/0065206 | A1 * | 3/2010 | Romes | 156/293 |

* cited by examiner

*Primary Examiner* — Erma Cameron

(74) *Attorney, Agent, or Firm* — Dority & Manning, P.A.

(57) ABSTRACT

A surface is insulated by applying an elastomeric foam material. In one embodiment, the elastomeric foam material comprises a polyurethane foam that is formed on-site by reacting an isocyanate with a polyol. In one embodiment, the polyol may include a polyol chain extender and/or a plasticizer. In one embodiment, the elastomeric foam material forms an air barrier against a surface. After the elastomeric foam material is installed, a fibrous insulation material may be then placed over the foam layer.

15 Claims, 2 Drawing Sheets

ELASTOMERIC FOAM PRODUCT

RELATED APPLICATIONS

The present application is based on and claims priority to U.S. Provisional Patent Ser. No. 61/096,497, filed on Sep. 12, 2008.

BACKGROUND

Properly insulating structures such as buildings and homes continues to gain in importance especially in view of rising energy costs. One of the most common ways to insulate buildings and homes is to install batts of fiberglass or blown fiberglass insulation around the exterior walls of the structure. For example, fiberglass insulation materials are typically used to insulate attics, crawl spaces, and vertical wall cavities. Such materials have been found well suited to preventing heat from escaping from the insulated area in colder months and cool air from escaping from the area in hotter months.

Although fiberglass insulation materials have very desirable R-values in static conditions, the thermal performance of the materials significantly decreases when subjected to air flow. Thus, in the past, builders have applied a spray foam material, such as a polyurethane foam, to a surface to be insulated prior to installing fiberglass insulation. The rigid polyurethane foam has been found to serve as an effective air flow barrier while also providing other beneficial insulation characteristics.

The polyurethane foams are typically formed on site by mixing a polyol with an isocyanate. Isocyanates used in the past have typically comprised aromatic isocyanates, such as diphenylmethane diisocyanate (MDI) or toluene diisocyanate (TDI). Specifically, in order to form a foam, the isocyanate component is combined with a polyol in the presence of a blowing agent and sprayed out of a nozzle onto the surface to be treated.

One of the disadvantages to using a ridged polyurethane foam as an air barrier is that the material is prone to crack or pull away from the surface being insulated either at the time the foam is installed or years later as the structure or building moves or settles. Air infiltration can occur where the foam has cracked or pulled away from the surface, thus negating some of the original benefits of installing the foam.

In view of the above, a need currently exists for an improved insulation system including an air barrier that does not crack or pull away from the surface being insulated.

SUMMARY

In general, the present disclosure is directed to a process and system for installing a foam insulation on a surface. The surface, for instance, may comprise a portion of a building, a home, or other similar structure. The surface, for instance, may be part of an attic, a crawl space, a vertical wall, or the like. In accordance with the present disclosure, the foam insulation comprises an elastomeric foam. The elastomeric foam, for instance, is flexible and thus will stretch and compress and fill in any cavities associated with the surface when installed. Since the elastomeric foam is flexible, the foam also resists cracking and prevents voids from forming after installation.

The foam, which may comprise an elastomeric polyurethane foam, can be formed on site from an A component and a B component. The foam can be co-blown or blown in the presence of a blowing agent, which may comprise water, any other suitable liquid, or any suitable gas.

For example, in one embodiment, the present disclosure is directed to a process for insulating a surface comprising the step of applying an elastomeric polyurethane foam on the surface. The elastomeric polyurethane foam is formed by combining an A component with a B component. The A component may comprise an aromatic isocyanate monomer.

The B component, on the other hand, comprises a polyol that, once reacted with the isocyanate, forms an elastomeric foam. The particular polyol chosen may depend upon various factors. Examples of polyols that can be used in the B component include polyether polyols, polyester polyols, polycarbonate polyols, polyacetal polyols, polyolefin polyols, caprolactone-based polyols, and the like.

In one embodiment, the polyol may comprise a polyoxyalkylene polyol. The polyol, for instance, may comprise a polyoxyethylene polyol, a polyoxypropylene polyol, or a polyoxy(ethylene-propylene) polyol.

In one embodiment, the polyol may be used in conjunction with a polyol chain extender. The polyol chain extender may comprise, for instance, an aliphatic diol, an aminoalcohol, a diamine, a hydroquinone, or mixtures thereof. Particular examples of polyol chain extenders include ethylene glycol, 1,3-propane diol, 2-methyl-1,3-propane diol, 1,4-butaine diol, 1,5-pentane diol, 1,6-hexane diol, 1,2-propane diol, 1,3-butane diol, 2,3-butane diol, 1,3-pentane diol, 1,2-hexane diol, 3-methyl pentane-1,5-diol, 2,2-dimethyl-1,3-propane diol, diethylene glycol, dipropylene glycol, or tripropylene glycol. If desired, the B component may also contain a plasticizer. Examples of plasticizers include an alkyl aryl phthalate, an alkyl benzyl phthalate, a phosphate ester, or a benzoate.

The isocyanate monomer contained in the A component, on the other hand, may comprise diphenylmethane diisocyanate, toluene diisocyanate, polyphenyl polymethylene polyisocyanate, or mixtures thereof.

In one embodiment, the elastomeric foam layer formed on the surface to be insulated includes a first side placed adjacent to the surface and a second and opposite side. Depending upon the reactants used to form the foam material, the second side may define a skin layer. The skin layer, for instance, may comprise a film layer that is integral with the formed foam. The skin layer can have a thickness, for instance, of from about 0.5 mm to about 3.5 mm.

After the elastomeric foam layer is applied to the surface to be insulated, in one embodiment, further insulation materials can be placed over the foam layer. For instance, a fibrous insulation material, such as a fiberglass insulation, can be applied over the foam layer.

In an alternative embodiment, the elastomeric foam can be used in a "full cavity fill" application. In this embodiment, for instance, the foam can be formed in the cavities in amounts such that the cavities are completely filled with the foam.

In addition to a process for insulating a surface, the present disclosure is also directed to an insulated structure. The insulated structure comprises a layer of elastomeric foam insulation located on a surface to be insulated. The elastomeric foam insulation may comprise a polyurethane foam as described above that is formed from an isocyanate and a polyol. In one embodiment, a layer of fiberglass insulation may be installed over the layer of the elastomeric foam insulation.

Other features and aspects of the present disclosure are discussed in greater detail below.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

Figure 1:
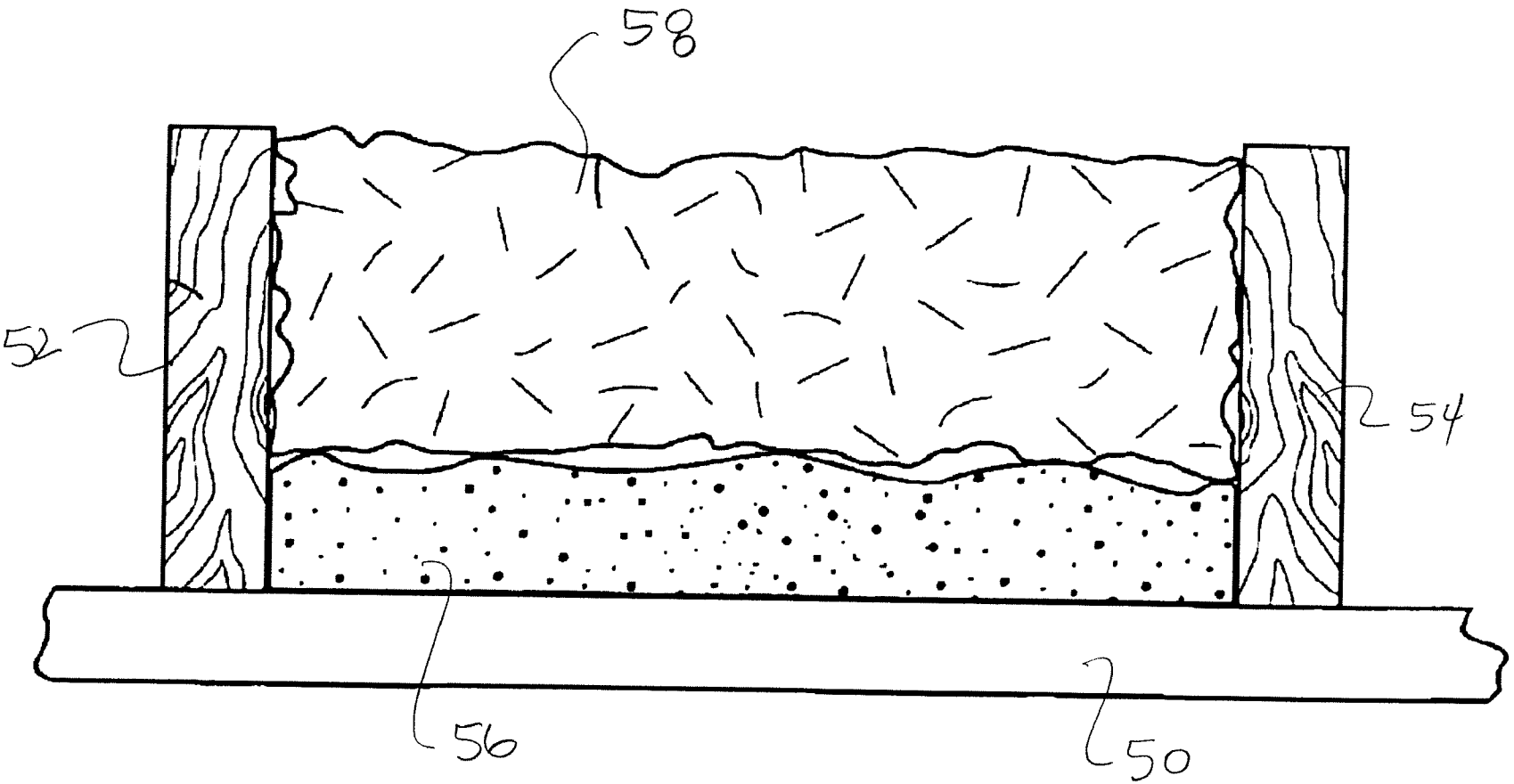
FIG. 1 is a cross-sectional view of one embodiment of an insulated structure made in accordance with the present disclosure.

Repeat use of reference characters in the present specification and drawings is intended to represent the same or analogous features or elements of the present invention.

DETAILED DESCRIPTION

It is to be understood by one of ordinary skill in the art that the present discussion is a description of exemplary embodiments only, and is not intended as limiting the broader aspects of the present invention.

In general, the present disclosure is directed to a process and system for installing elastomeric foam installation. Although the elastomeric foam can be formed off-site and later installed, in one embodiment, the present disclosure is directed to forming the foam on site and spraying the foam directly onto the surface to be insulated. The elastomeric foam, which may be a polyurethane foam, is formed from a two component system. The two components can be mixed together and sprayed through a nozzle to form the foam insulation material.

In order to form the elastomeric foam material, the first component contains an isocyanate while the second component contains a polyol. The second component may also contain a catalyst, a blowing agent, a flame retardant, and the like. In accordance with the present disclosure, a polyol is selected that, once reacted with the isocyanate, forms an elastomeric foam.

The formation of an elastomeric foam provides various advantages and benefits over ridged polyurethane foams used in the past. For instance, the elastomeric foam is flexible and therefore stretches and compresses to fill voids that may be found along a surface to be insulated. More particularly, the elastomeric foam, in one embodiment, can have form fitting properties for improving the air barrier characteristics of the layer. Elastomeric foams, since they are flexible, are not prone to cracking or otherwise deteriorating over time.

Figure 2:
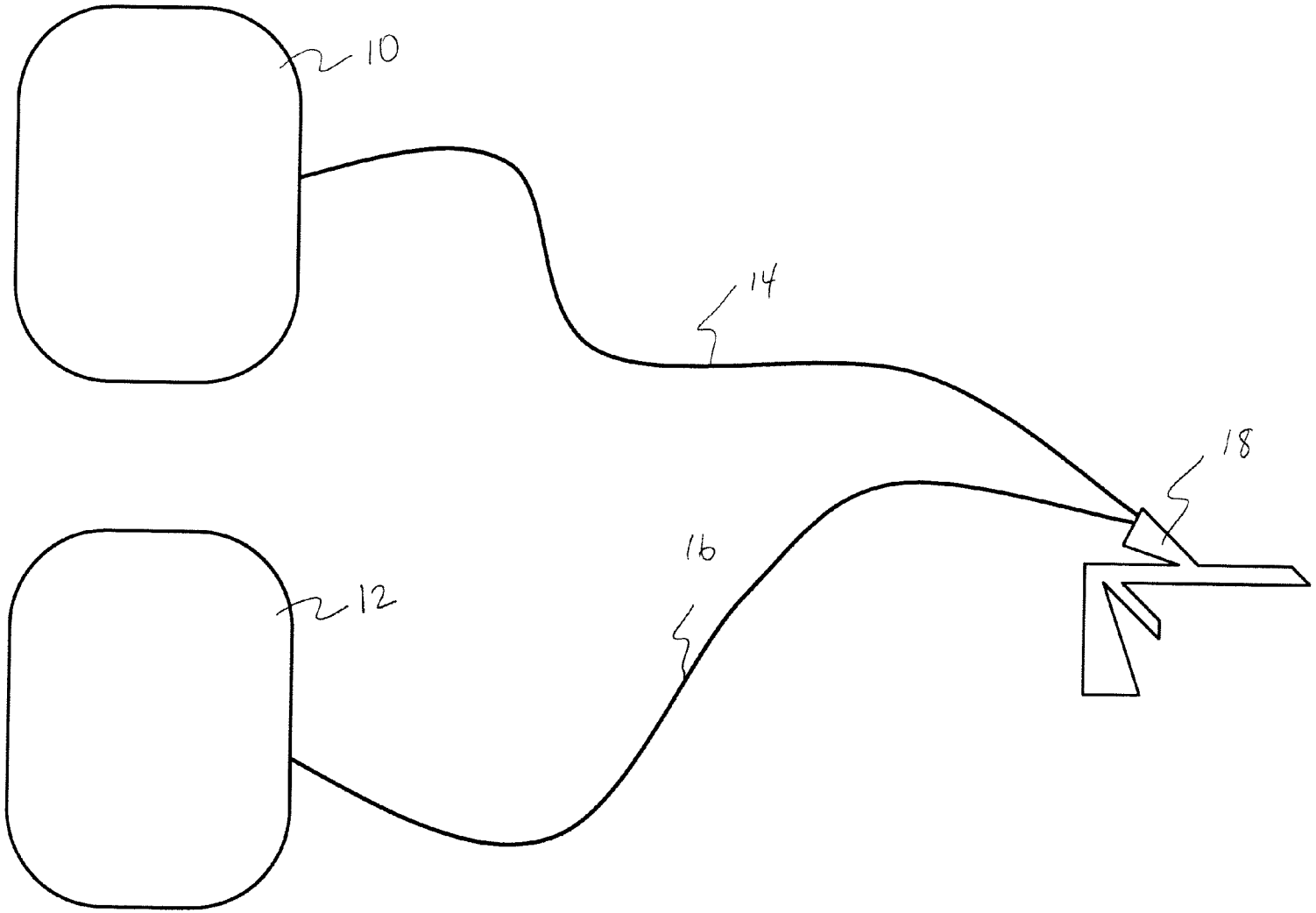
FIG. 2 is a diagrammatical view of one embodiment of a system for producing a spray foam insulation in accordance with the present disclosure.

Referring to FIG. 2, for exemplary purposes, one embodiment of a system that may be used to form and install a polyurethane foam material in accordance with the present disclosure is illustrated. As shown, the system includes a first pressurized container 10 for containing a first component typically referred to as the "A" component and a second pressurized container 12 for containing a second component typically referred to as the "B" component. The container 10 is in communication with a nozzle 18 that may comprise a spray gun via a tubular channel 14. Similarly, the second container 12 is in communication with the nozzle 18 by a second tubular channel 16. The tubular channels 14 and 16 may comprise, for instance, hoses.

The two components contained in the two containers 10 and 12 are combined in the nozzle 18 and formed into a foam which may be applied directly to a surface being insulated. The two components can be mixed in the nozzle 18 alone or in the presence of a blowing agent which can be added to the nozzle separately or contained in one of the components.

When the two components are combined in the nozzle 18, an exothermic reaction takes place as the resulting material is emitted from the nozzle. Small bubbles form during the reaction which become trapped in the newly formed material. As the foam is applied to a surface, the foam cures and hardens. In one embodiment, the foam may expand as it cures. The amount of expansion may depend upon the particular reactants being used. Of advantage, the polyurethane foam has natural adhesive qualities which allow the foam to attach and bond to a surface. Ultimately, an elastomeric foam can be produced that either has open cells or closed cells.

The amount of pressure that is placed upon the components in the containers 10 and 12 can depend upon the particular application and the desired result. In some embodiments, the tanks 10 and 12 may be under relatively low pressure, such as less than about 200 psi, such as less than about 100 psi. In other embodiments, however, a higher pressure may be desirable. For instance, the containers 10 and 12 may be under a pressure of greater than about 200 psi, such is greater than about 300 psi, such is even greater than about 400 psi. In one embodiment, for example, the containers 10 and 12 may be used in a relatively high pressure system in which the containers are under a pressure of greater than about 900 psi, such as from about 1000 psi to about 1400 psi.

The A component located in the container 10 generally contains an isocyanate monomer. The isocyanate used in the A component can vary depending upon the particular application. In general, the isocyanate is an aromatic isocyanate. Examples of aromatic isocyanates, include, for instance, diphenylmethane diisocyanate (MDI), toluene diisocyanate (TDI), mixtures thereof, or any oligomers, pre-polymers, dimmers, trimers, allophanates, or uretidiones thereof.

Other isocyanates that may be used include hexamethylene diisocyanate (HMDI), HDI, IPDI, TMXDI (1,3-bis-isocyanato-1-methylene ethylene benzene), or any of their oligomers, pre-polymers, dimmers, trimers, allophanates and uretidiones.

Further, suitable polyisocyanates include, but are not limited to, toluene-2,4-diisocyanate, toluene-2,6-diisocyanate, (this is TDI 80/20 from above) commercial mixtures of toluene-2,4- and 2,6-diisocyanates, ethylene diisocyanate, ethylidene diisocyanate, propylene-1,2-diisocyanate, cyclohexylene-1,2-diisocyanate, cyclohexylene-1,4-diisocyanate, m-phenylene diisocyanate, 3,3'-diphenyl-4,4'-biphenylene diisocyanate, 4,4'-biphenylene diisocyanate, 3,3'-dichloro-4,4'-biphenylene diisocyanate, 1,6-hexamethylene diisocyanate, 1,4-tetramethylene diisocyanate, 1,10-decamethylene diisocyanate, 1,5-naphthalenediisocyanate, cumene-2,4-diisocyanate, 4-methoxy-1,3-phenylenediisocyanate, 4-chloro-1,3-phenylenediisocyanate, 4-bromo-1,3-phenylenediisocyanate, 4-ethoxy-1,3-phenylenediisocyanate, 2,4'-diisocyanatodiphenylether, 5,6-dimethyl-1,3-phenylenediisocyanate, 2,4-dimethyl-1,3-phenylenediisocyanate, 4,4'-diisocyanatodiphenylether, benzidinediisocyanate, 4,6-dimethyl-1,3-phenylenediisocyanate, 9,10-anthracenediisocyanate, 4,4'-diisocyanatodibenzyl, 3,3'-dimethyl-4,4'-diisocyanatodiphenylmethane, 2,6-dimethyl-4,4-diisocyanatodiphenyl, 2,4-diisocyanatostilbene, 3,3'-dimethyl-4,4'-diisocyanatodiphenyl, 3,3'-dimethoxy -4,4'-diisocyanatodiphenyl, 4,4'-methylene bis(diphenyl) socyanate), 4,4'-methylene bis(dicyclohexylisocyanate), isophorone diisocyanate, PAPI (a polymeric diphenylmethane diisocyanate, or polyaryl polyisocyanate), 1,4-anthracenediisocyanate, 2,5-fluorenediisocyanate, 1,8-naphthalenediisocyanate and 2,6-diisocyanatobenzfuran.

Also suitable are aliphatic polyisocyanates such as the triisocyanate Desmodur N-100 sold by Mobay (Mobay no longer exists, a BAYER company now) which is a biuret adduct of hexamethylenediisocyanate; the diisocyanate Hylene W sold by du Pont, which is 4,4'-dicyclohexylmethane diisocyanate; the diisocyanate IPDI or Isophorone Diisocyanate sold by Thorson Chemical Corp., 25 which is 3-isocyanatomethyl-3,5,5-trimethylcyclohexyl isocyanate; or the diisocyanate THMDI sold by Verba-Chemie, which is a mixture of 2,2,4- and 2,4,4-isomers of trimethyl hexamethylene diisocyanate.

Further examples of suitable isocyanate components include 2,4-tolylenediisocyanate, 2,6-tolylenediisocyanate, 4,4'-diphenylmethanediisocyanate, 4,4'-diphenylthere-diisocyanate, m-phenylenediisocyanate, 1,5-naphthalene -diisocyanate, biphenylenediisocyanate, 3,3'-dimethyl-4,4'biphenylenediisocyanate, dicyclohexylmethane-4,4'diisocyanate, p-xylylenediisocyanate, bis(4-isocyanatophynyl) sulfone, isopropylidene bis(4-phenylisocyanate), tetramethylene diisocyanate, isophorone diisocyanate, ethylene diisocyanate, trimethylene, propylene-1,2-diisocyanate, 15 ethylidene diisocyanate, cyclopentylene-1,3-diisocyanates, 1,2-,1,3- or 1,4-cyclohexylene diisocyanates, 1,3- or 1,4-phenylene diisocyanates, polymethylene polyphenylleisocyanates, bis (4-isocyanatophenyl)methane, 4,4'-diphenylpropane diisocyanates, bis(2-isocyanatoethyl) carbonate, 1-methyl-2,4-diisocyanatocycloheane, chlorophenylene diisocyanates, triphenylmethane-4,4'4"-triisocyanate, isopropyl benzene-a-4-diisocyanate, 5,6-diisocnanatobutylbicyclo [2.2.1]hept-2ene, hexahydrotolylene diisocyanate, 1-methoxyphenyl-2, 4-diisocyanate, 4,4'4"-triphenylmethane triisocyanate, polymethylene polyohenylisocyanate, tolylene-2,4,6-triisocyanate, 4,4'-dimethyldiphenylmethane-2,2'5, 5'-tetraisocyanate, and mixtures thereof.

The B component contained in the second pressurized container 12 contains any suitable polyol capable of reacting with the isocyanate in forming an elastomeric foam material. Selection of the polyol contained in the B component may depend on numerous factors. For instance, the polyol selected for forming the foam can influence the final properties of the material.

As used herein, "polyol" refers to a molecule than contains more than one hydroxyl group. Thus, in one embodiment, the polyol may comprise a diol. Examples of polyols that can be used in the B component include polyether polyols including diols and triols, polyester polyols, polycarbonate polyols, polyacetal polyols, polyolefin polyols, caprolactone-based polyols, and the like.

In one embodiment, for instance, a polyoxypropylene polyol, a polyoxyethylene polyol or a poly(oxyethylene-oxypropylene) polyol may be used. For example, one commercially available polyether triol that may be included in the B component is sold under the trade name XD 1421, which is made by the Dow Chemical Company. It has a molecular weight of around 4900, and is composed of a ratio of three oxyethylene units randomly copolymerized per one unit of oxypropylene. This is commonly called ethylene oxide above and propylene oxide for the later. It has a hydroxy content of 0.61 meq. OH/g. Another example of a material which is commercially available is Pluracol™. V-7 made by BASF Wyandotte which is a high molecular weight liquid polyoxyalkylene polyol. Other polyols which might be used at polyether polyols such as Pluracol 492 from BASF, having a molecular weight of 2000.

Polyester polyols that may be used are generally prepared from the condensation of a saturated or unsaturated mono- or poly-carboxylic acid and a polyhydric alcohol. Examples of suitable polyhydric alcohols include the following: glycerol; pentaerythritol; mannitol; trimethylolpropane; sorbitol; methyltrimethylolmethane; 1,4,6-octanetriol; ethylene glycol, diethylene glycol, propylene glycol butanediol; pentanediol; hexanediol; dodecanediol; octanediol; chloropentanediol, glycerol monoallyl ether glycerol; monoethyl ether; triethylene glycol; 2-ethyl hexanediol-1,4; 3,3'-thiodipropanol; 4, 4'-sulfonyldihexanol; cyclohexanediol-1,4; 1,2,6-hexanetriol, 1,3,5 hexanetriol; polyallyl alcohol; 1,3-bis (2-hydroxyethoxy) propane; 5,5'-dihydroxydiamyl ether; 2,5-dipropanol tetrahydrofuran-2,5-dipentanol, 2,5-dihydroxytetrahydro furan; tetrahydropyrrole-2,5 propanol; 3,4-dihydroxy tetrahydropyran; 2,5-dihydroxy-3,4-dihydro-1,2 pyran; 4,4'-sulfinyldipropanol; 2,2-bis(4-hydroxyphenyl)-propane; 2, 2'-bis(4-hydroxyphenyl)methane, and the like.

Examples of polycarboxylic acids include the following: phthalic acid, isophthalic acid; tetrachlorophthali acid; maleic acid; dodecylmaleic acid; octadecenylmalei acid; fumaric acid; aconitic acid, itaconic acid, trimellitic acid; tricarballylic acid; 3,3'-thiodipropionic acid; 4,4'-sulfonyldihexanoic acid; 3-octenedioic-1,7 acid; 3-methyl-3decenedioic acid; succinic acid; adipic acid; 1,4-cyclohexadiene-1, 2-dicarboxylic acid; 3-methyl-3,5-cyclohexadiene 1, 2-dicarboxylic acid; 8,12-eicosadienedioic acid; 8-vinyl10-octadecenedioic acid; and the corresponding acid anhydrides, acid chlorides, and acid esters such as phthalic anhydride, phthaloyl chloride, and the dimethyl ester of phthalic acid. Other polyols may be used herein such as specialty types that are not considered as being purely polyester polyol.

Particular polyester polyols which may be used include hydroxyl-terminated reaction products of dihydric alcohols such as ethylene glycol, propylene glycol, diethylene glycol, 1,4-butanediol, neopentyl glycol, 1,6-hexanediol or cyclohexane dimethanol or mixtures of such dihydric alcohols, and dicarboxylic acids or their ester-forming derivatives, for example succinic, glutaric and adipic acids or their dimethyl esters, sebacic acid, phthalic anhydride, tetrachlorophthalic anhydride or dimethyl terephthalate or mixtures thereof.

Polyesteramides may be obtained by the inclusion of aminoalcohols such as ethanolamine in polyesterification mixtures.

Polythioether polyols which may be used include products obtained by condensing thiodiglycol either alone or with other glycols, alkylene oxides, dicarboxylic acids, formaldehyde, amino-alcohols or aminocarboxylic acids.

Polycarbonate polyols which may be used include products obtained by reacting diols such as 1,3-propanediol, 1,4-butanediol, 1,6-hexanediol diethylene glycol or tetraethylene glycol with diaryl carbonates, for example diphenyl carbonate, or with phosgene.

Polyacetal polyols which may be used include those prepared by reacting glycols such as diethylene glycol, triethylene glycol or hexanediol with formaldehyde. Suitable polyacetals may also be prepared by polymerising cyclic acetals.

Suitable polyolefin polyols include hydroxy-terminated butadiene homo- and copolymers and suitable polysiloxane polyols include polydimethylsiloxane diols.

In one embodiment, a polyol chain extender may be included in component B. The chain extender may be used to increase the length of the carbon chains in the polyurethane foam compositions. Suitable chain extenders include aliphatic diols, such as ethylene glycol, 1,3-propanediol, 2-methyl-1,3-propanediol, 1,4-butanediol, 1,5-pentanediol, 1,6-hexanediol, 1,2-propanediol, 1,3-butanediol, 2,3-butanediol, 1,3-pentanediol, 1,2-hexanediol, 3-methylpentane-1,5-diol, 2,2-dimethyl-1,3-propanediol, diethylene glycol, dipropylene glycol and tripropylene glycol, and aminoalcohols such as ethanolamine, N-methyldiethanolamine, N-ethyldiethanolamine and the like. Other chain extenders that may be used include hydroquinone di(ethyl ether) or primary diamines such as ethylene diamine, hydrazine, 3,5-diethyl toluene diamine, or methylene bis-orthochloraniline.

The polyol used in component B may have any suitable molecular weight. For instance, the molecular weight of the polyol may be greater than about 1000, such as from about 2000 to about 10,000. The polyol may also have a hydroxyl number of greater than about 300, such as greater than about 1000. For instance, the polyol may have a hydroxyl number of from about 300 to about 3000.

In addition to a polyol, the B component may also contain a catalyst. The catalyst may comprise, for instance, an amine compound or an organometallic complex. Amine catalysts that may be used include triethylenediamine, dimethylcyclohexylamine, dimethylethanolamine, tetramethylbutanediamine, bis-(2-dimethylaminoethyl)ether, triethylamine, pentamethyldiethylenetriamine, benzyldimethylamine, and the like.

Organometallic catalysts that may be used include compounds based on mercury, lead, tin, bismuth, or zinc. Particular examples of organometallic catalysts are alkyltincarboxylates, oxides and mercaptides oxides.

It should be understood, however, that in some applications a catalyst may not be needed.

In addition to a catalyst, the B component may also contain a plasticizer. In one embodiment, for instance, a phthalate plasticizer may be used. Examples of plasticizers include alkyl aryl phthalates, or alkyl benzyl phthalates, including butyl benzyl phthalate, alkyl benzyl phthalate wherein the alkyl group has a carbon chain of from seven to nine carbon atoms. Texanol benzyl phthalate, alkyl phenyl phthalate, symmetrical and unsymmetrical dialkyl phthalates including diisononyl phthalate, diisodecyl phthalate, dioctyl phthalate, dihexyl phthalate, diheptyl phthalate, butyloctyl phthalate, linear dialkyl phthalate wherein the alkyl groups are independently carbon chains having from seven to eleven carbon atoms, and butyl cyclohexyl phthalate; and phosphate ester plasticizers such as, for example, 2-ethylhexyl diphenyl phosphate, isodecyl diphenyl phosphate, mixed dodecyl and tetradecyl diphenyl phosphate, trioctyl phosphate, tributyl phosphate, butylphenyl diphenyl phosphate and isopropylated triphenyl phosphate; and benzoate plasticizers such as, for example, Texanol benzoate, glycol benzoate, propylene glycol dibenzoate, dipropylene glycol dibenzoate and propylene glycol dibenzoate.

To form the foam material, component A is combined with component B under pressure and in the presence of a blowing agent. The relative amount of component A that is combined with component B generally depends on the particular reactants that are used. In general, the two components are combined together in stoichiometric amounts or in the presence of excess polyol.

The blowing agent, in one embodiment, may comprise water. In fact, water has been found to be well suited for use in the process of the present disclosure. When water is used as the blowing agent, the water may be contained in the B component.

In addition to water, other blowing agents that may be used include chlorofluorocarbons, hydrofluorocarbons, or hydrochlorofluorocarbons. Still other blowing agents that may be used include carbon dioxide, pentane or various hydrocarbons.

The amount of blowing agent used in any particular application depends upon the reactants, the pressure at which the components are mixed, and various other factors. In general, for instance, the blowing agent may be present in an amount greater than zero to greater than about 20 parts by weight. The particular blowing agent used in the process and the amount of blowing agent may also have an impact upon the cell structure of the resulting foam. For instance, use of a particular blowing agent may result in an open cell structure or a closed cell structure.

In one embodiment, the two components can be reacted together to form an elastomeric foam layer that includes an outer exterior skin layer. The skin layer, which represents a film integral with the foam material, may provide various advantages and benefits. For example, the skin layer may not only further improve the air barrier properties of the material but may also provide a smooth surface for applying a second insulation layer, such as a fibrous insulation layer. The thickness of the skin layer can vary depending upon the particular reactants used. In one embodiment, for instance, the skin layer can have a thickness of from about 0.5 mm to about 3.5 mm.

When forming an elastomeric foam material from component A and component B as described above, the foam material can be created offsite and installed or created onsite. When created onsite, for instance, the components can be mixed together and sprayed directly on the surface to be insulated.

Referring to FIG. 1, for exemplary purposed only, a surface 50 insulated in accordance with the present disclosure is shown. More particularly, FIG. 1 is intended to illustrate a cross-sectional view of an insulated wall cavity. It should be understood, however, that foams made according to the present disclosure can be used to insulate various other areas of a structure or building as well. In this embodiment, the surface 50 comprises a wall that is attached to a pair of studs 52 and 54. In between the pair of studs 52 and 54 is a layer of elastomeric foam material 56 made in accordance with the present disclosure. The elastomeric foam insulation 56 is applied to the surface 50 in order to insulate the wall and particularly prevent airflow through the cavity.

As shown, in this embodiment, the elastomeric foam material 56 is positioned in between the surface 50 and a layer of other insulation 58. The insulation 58 may comprise, for instance, fiberglass insulation, cellulose insulation, or the like. When the elastomeric foam material 56 is combined with a batt of insulation material 58 as shown in FIG. 1, the elastomeric foam material can serve as an air barrier for preventing or reducing airflow from reaching the batt of insulation 58 which may have detrimental effects on the ability of the batt of insulation to insulate the surface. Thus, the elastomeric foam material 56 can block or substantially block airflow through the cavity and thereby maintain or even improve the R-value of the batt of insulation 58.

The thickness of the elastomeric foam layer 56 and of the fibrous insulation layer 58 can vary depending upon the particular application and the amount of insulation needed. The foam layer, for instance, in one embodiment can have a thickness of from about 0.25 inches to about 2 inches. The fibrous insulation layer, on the other hand, may have a thickness of from about 2 inches to about 12 inches. The elastomeric foam can have any suitable density depending upon the particular application. The density of the foam, for instance, can be at least about 1 $lb/ft^3$. In one embodiment, for instance, the density can be from about 1.5 $lbs/ft^3$ to about 2.5 $lbs/ft^3$, such as from about 1.75 $lbs/ft^3$ to about 2 $lbs/ft^3$. The resulting foam can be compressible and/or flexible. The foam can also have elastic properties. For instance, the foam can have an elongation of over 125 percent, such as over 150 percent, such as over 175 percent. For example, in one embodiment, the foam can have an elongation of from about 150 percent to about 300 percent.

Insulation products are typically rated in the building industry by an R-value. The higher the R-value, the greater the insulation properties. The R-value of a material is a measure of apparent thermoconductivity and thus describes the rate that heat energy is transferred through a material or assembly. The elastomeric foam and fibrous insulation laminate, for instance, can generally have an R-value of from about R-12 to about R-50, or even higher. The fibrous insulation material, for instance, can have an R-value of from about R-10 to about R-40. The elastomeric foam material, on the other hand, can generally have an R-value of from about R-2 to about R-10. Higher R-values are achievable by changing the material and/or the thicknesses of the material.

In the embodiment illustrated in FIG. 1, the elastomeric foam material 56 is positioned directly adjacent to the surface 50. It should be understood, however, that in other embodiments, the batt of insulation 58 may be positioned in between the surface 50 and the foam material 56. In still another embodiment, two layers of foam material 56 may be provided. In this embodiment, the batt of insulation 58 may be positioned in between the two foam layers.

In addition to wall cavities as shown in FIG. 1, the elastomeric foam material of the present disclosure may be used to insulate any other suitable surface. Further, the foam insulation may be used with a batt of insulation as shown in FIG. 1 or without the batt of insulation.

In one embodiment, when the elastomeric foam material is used to insulate a structure without the use of any other insulation materials, the foam may be applied to surfaces in order to fill any cavities present on the surfaces. For example, as shown in FIG. 1, in one embodiment, the foam material may be used to completely fill the space in between the studs 52 and 54. This manner of using the foam is sometimes referred to as a "full cavity" application.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. A process for insulating a surface comprising:

applying an elastomeric polyurethane foam onto a building surface to be insulated, the elastomeric polyurethane foam being formed by combining an A component with a B component in the presence of a blowing agent, the A component comprising an aromatic isocyanate monomer, the B component comprising a polyol that, once reacted with the aromatic isocyanate monomer, forms an elastomeric foam; and placing a layer of fiberglass insulation adjacent to the polyurethane foam insulation.

2. A process as defined in claim 1, wherein the aromatic isocyanate monomer comprises diphenylmethane diisocyanate.

3. A process as defined in claim 1, wherein the elastomeric polyurethane foam formed from the A component and the B component comprises a closed cell foam.

4. A process as defined in claim 1, wherein the polyol comprises a polyoxyalkylene polyol.

5. A process as defined in claim 1, wherein the polyol comprises a polyether triol.

6. A process as defined in claim 1, wherein the polyol comprises a polyoxyethylene polyol, a polyoxypropylene polyol or a poly(oxyethylene-oxypropylene) polyol.

7. A process as defined in claim 1, wherein the B component further comprises a polyol chain extender.

8. A process as defined in claim 7, wherein the polyol chain extender comprises an aliphatic diol.

9. A process as defined in claim 7, wherein the polyol chain extender comprises ethylene glycol.

10. A process as defined in claim 1, wherein the polyol has a molecular weight between 2000 and 10,000.

11. A process as defined in claim 1, wherein the B component further comprises a plasticizer.

12. A process as defined in claim 11, wherein the plasticizer comprises an alkyl aryl phthalate.

13. A process as defined in claim 1, wherein the elastomeric polyurethane foam has a first side and a second and opposite side, the first side of the elastomeric polyurethane foam being placed adjacent to the surface to be insulated, the second side of the elastomeric polyurethane form defining a skin layer that is produced as the elastomeric foam is formed.

14. A process as defined in claim 13, wherein the skin layer has a thickness of from about 0.5 mm to about 3.5 mm.

15. A process as defined in claim 1, wherein the blowing agent comprises water.

* * * * *